US006010992A

United States Patent [19]

Arvanitidou et al.

[11] Patent Number: 6,010,992

[45] Date of Patent: Jan. 4, 2000

[54] LIQUID DETERGENT COMPOSITION CONTAINING AMINE OXIDE AND CITRIC ACID

[75] Inventors: Evangelia Arvanitidou, Kendall Park; Gary Jakubicki, Robinsville, both of N.J.

[73] Assignee: Colgate-Palmolive Co., Piscataway, N.J.

[21] Appl. No.: 09/323,576

[22] Filed: Jun. 1, 1999

[51] Int. Cl.[7] ..... C11D 1/75; C11D 1/12; C11D 3/22; C11D 1/22

[52] U.S. Cl. ..... 510/237; 510/235; 510/470; 510/477; 510/503; 510/426; 510/427; 510/428

[58] Field of Search ..... 510/235, 237, 510/470, 477, 503, 426, 427, 428

[56] References Cited

U.S. PATENT DOCUMENTS

| | | | |
|---|---|---|---|
| 5,767,051 | 6/1998 | Drapier et al. | 510/235 |
| 5,874,393 | 4/1997 | Drapier et al. | 510/417 |
| 5,929,024 | 7/1999 | Stringer et al. | 510/504 |

*Primary Examiner*—Yogendra Gupta
*Assistant Examiner*—Charles Boyer
*Attorney, Agent, or Firm*—Richard E. Nanfeldt

[57] ABSTRACT

A liquid detergent composition with improved pH and color stability comprising an amine oxide, citric acid and water.

2 Claims, No Drawings

LIQUID DETERGENT COMPOSITION CONTAINING AMINE OXIDE AND CITRIC ACID

FILED OF THE INVENTION

The present invention relates to novel light duty liquid detergent compositions containing amine oxide and citric acid which have improved pH and color stability.

BACKGROUND OF THE INVENTION

There are numerous patents which describe liquid detergent compositions containing an amine oxide surfactant in combination with one or more other surfactants such as anionic surfactants. Some of these U.S. Pat. Nos. are 4,316,824; 4,435,317; 4,536,317; 4,536,318; 4,663,063; 4,599,188; 4,555,360; 5,118,440; 5,320,783; 5,417,893 and 5,415,814.

A major problem for a liquid detergent composition containing an amine oxide is color stability. Formulas containing amine oxide discolor upon aging due to heat or the ultraviolet rays of sunlight. Decomposition of the amine oxide accompanied by an increase in pH is also observed in these systems. The use of hydroxyethylethylenediamine-tetraacetic acid (HEEDTA) as a chelant to improve color stability has only been marginally successful.

The present invention teaches that the pH and color stability of a liquid detergent composition containing amine oxides can be dramatically improved through the use of citric acid as a chelant in place of HEEDTA.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric acid ester salt of an ethylene oxide adduct of a secondary alcohol, and an amphoteric surfactant which may be a betaine, wherein either the anionic or nonionic surfactant may be the major ingredient. The specific class of anionics utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

SUMMARY OF THE INVENTION

It has now been found that a liquid detergent composition can be formulated with an amine oxide surfactant which has desirable cleaning properties and improved color stability.

Accordingly, one object of the invention is to provide a light duty liquid detergent compositions containing amine oxide which has improved color stability and which has improved skin feel properties.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the light duty liquid detergent of this invention having improved color stability comprises an amine oxide, citric acid, alkyl polyglucoside surfactant, at least one linear alkyl benzene sulfonate surfactant and ethoxylated alkyl ether sulfate surfactant and water wherein the composition does not contain any inorganic detergent builder salts or hydroxy ethylene diamine tetraacetic acid or pentasodium salt of diethylene triamine pentaacetic acid.

DETAILED DESCRIPTION OF THE INVENTION

The present invention relates to a light duty liquid composition which, optionally, can be in a microemulsion form comprising approximately by weight:

(a) 0.1% to 15%, more preferably 0.5% to 10% of an amine oxide;

(b) 1% to 5%, more preferably 2% to 4% of a sodium salt of a $C_8$–$C_{18}$ linear alkyl benzene sulfonate surfactant;

(c) 5% to 15%, more preferably 7% to 12% of a magnesium salt of a $C_8$–$C_{18}$ linear alkyl benzene sulfonate surfactant;

(d) 0 to 15%, more preferably 0.1% to 10% of a solubilizing agent;

(e) 5% to 15%, more preferably 7% to 13% of a $C_8$–$C_{18}$ ethoxylated allyl ether sulfate surfactant;

(f) 5% to 15%, more preferably 7% to 13% of an alkyl polyglucoside surfactant;

(g) 0.01% to 0.2% of a citric acid; and (h) the balance being water, wherein the composition does not contain any hydroxy ethylene diamine tetraacetic acid (HEDTA), an ethylene diamine tetraacetic acid or pentasodium salt of diethylene triamine pentaacetic acid and the composition is not a liquid crystal or microemulsion and does not contain a nonionic surfactant containing ethoxylate groups, an amino alkylene phosphonic acid, phosphoric acid, an aliphatic acid or hydroxy aliphatic acid, more than 0.3 wt. % of a perfume, water insoluble hydrocarbon having 6 to 18 carbon atoms or an essential oil, a grease release agent, polyvinyl pyrrolidone, polyethylene glycol or a partially or fully esterified ethoxylated polyhydric alcohol or an ethoxylated polyhydric alcohol.

The anionic surfactants which may be used in the composition of this invention are water soluble such as triethanolamine and include the sodium, potassium, ammonium and ethanolammonium salts of a $C_8$–$C_{20}$ fatty acid, a $C_8$–$C_{18}$ alkyl sulfates such as lauryl sulfate, myristyl sulfate and the like; $C_{8-18}$ ethoxylated alkyl ether sulfates; linear $C_8$–$C_{16}$ alkyl benzene sulfonates; $C_{10}$–$C_{20}$ paraffin sulfonates and alpha olefin sulfonates containing about 10–24 carbon atoms.

The C8–18 ethoxylated alkyl ethersulfate surfactants which may be used in the instant composition have the structure:

$$R—(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$; $C_{2-15}$ and M is an ammonium cation or an alkali metal cation, most preferably sodium or ammonium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %.

The magnesium and sodium salts of the sulfonate surfactant are the well known higher alkyl mononuclear aromatic sulfonates such as the higher alkyl benzene sulfonates containing from 8 to 18 carbon atoms, more preferably 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

The alkyl polysaccharides surfactants, which may be used have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6- positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is Glucopon 625 glycoside manufactured by the Henkel Corporation of Ambler, PA. APG 625 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization)= 1.6. Glucopon 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

Amine oxide semi-polar nonionic surfactants used in the instant compositions comprise compounds and mixtures of compounds having the formula

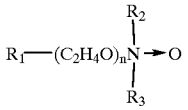

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

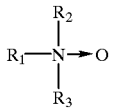

wherein $R_1$ is a $C_{12-16}$ alkyl, or cocoamidopropyl group and $R_2$ and $R_3$ are methyl or ethyl. The above ethylene oxide condensates, amides, and amine oxides are more fully described in U.S. Pat. No. 4,316,824 which is hereby incorporated herein by reference. Preferred amine oxides are lauryl amine oxide and cocoamido propyl amine oxide. The concentration of the amine oxide in the instant compositions is 3 to 12 wt. %, more preferably 4 to 10 wt. %

To the composition can also be added a solubilizing agent which can be water soluble hydrotropic salts include sodium, potassium, ammonium and mono-, di- and triethanolammonium salts of xylene sulfonate or cumene sulfonate a $C_1$ to $C_4$ alkanol such as ethanol and/or urea. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Various other ingredients such as urea at a concentration of 0.5 to 4.0 wt. % or urea at the same concentration in combination with ethanol at a concentration of 0.5 to 4.0 wt. % can be used as solubilizing agents.

The instant compositions have a minimum foam volume of 380 mls after 40 rotations at 25° C. as measured by the foam volume test using 0.033 wt. % of the composition in 150 ppm of water. The foam test is an inverted cylinder test in which 100 ml. of a 0.033 wt. % LDL formula in 150 ppm of $H_2O$ is placed in a stoppered graduate cylinder (500 ml) and inverted 40 cycles at a rate of 20 cycles/minute. After 40 inversions, the foam volume which has been generated is measured in mis inside the graduated cylinder. This value includes the 100 ml of LDL solution inside the cylinder.

The present liquid detergents such as dishwashing liquids are readily made by simple mixing methods from readily available components which, on storage, do not adversely affect the entire composition.

The following examples are merely illustrative of the invention and are not to be construed as limiting thereof.

DESCRIPTION OF THE PREFERRED EMBODIMENTS

EXAMPLE 1

The following compositions were evaluated visually for color stability upon aging. Samples were aged at 110° F. in PETE bottles for 13 weeks. Proportions are % by weight of the total compositions. A Macbeth Coloreye 7000 was used to make the color measurements (ClELab color scale in transmittance mode). Delta E values were calculated (increasing Delta E indicates increase change in color from the inital sample color).

| Ingredients | A | B | C |
|---|---|---|---|
| NaLas | 3.00% | 3.00% | 3.00% |
| MgLas | 9.02% | 9.02% | 9.02% |
| AEOS 1.3EO | 11.64% | 11.64% | 11.64% |
| APG | 10% | 10% | 10% |
| CAP AO | 6.34% | 6.34% | 6.34% |
| Sodium Bisulfite | 0.05% | 0.05 | 0.05% |
| Yellow color solution | 0.2 | 0.2 | 0.2 |
| Perfume | 0.3 | 0.3 | 0.3 |
| HEDTA | 0.083% | | |
| Versenex 80 | | 0.125% | |
| Citric acid | | | 0.1% |
| Water | Bal. | Bal. | Bal. |
| pH | | | |
| Initial | 7.03 | 6.99 | 7.01 |
| 110 F, 13 weeks | 7.58 | 7.65 | 7.46 |
| Color, Delta E 110 F, 13 weeks | 4.3 | 2.3 | 3.4 |
| Foam Volume Test | | | |
| Shake foam (initial) | 383 mls | 393 mls | 405 mls |
| Shake foam w. soil | 142 mls | 143 mls | 135 mls |

Citric acid used as a chelating agent offers less pH rise than HEDTA or Versenex 80. Versenex 80 and Citric Acid both reduce the change in color versus HEEDTA after 13 weeks aging at 110° F. At the same time the foam performance profile of the formula remains the same (at 95% c.l. 2-t).

What is claimed is:

1. A liquid detergent composition comprising approximately by weight:

(a) 0.1% to 15% of an amine oxide surfactant;

(b) 1% to 5% of a sodium salt of a $C_8$–$C_{18}$ linear alkyl benzene sulfonate surfactant;

(c) 5% to 15% of a magnesium salt of a $C_8$–$C_{18}$ linear alkyl benzene sulfonate surfactant;

(d) 5% to 15% of an alkyl polyglucoside surfactant;

(e) 5% to 15% of a $C_8$ to $C_{18}$ ethoxylated alkyl ether sulfate surfactant;

(f) 0.01% to 0.2% of citric acid; and (g) the balance being water.

2. A liquid detergent composition according to claim 1 further including 0.1 wt. % to 10.0 wt. % of a solubilizing agent.

* * * * *